US008701218B2

(12) United States Patent
Aldridge et al.

(10) Patent No.: US 8,701,218 B2
(45) Date of Patent: Apr. 22, 2014

(54) PROTECTIVE GARMENT WITH HANG-DOWN POCKETS

(75) Inventors: Donald Aldridge, New Carlisle, OH (US); Timothy B. Durby, Phoenix, AZ (US)

(73) Assignee: Lion Apparel, Inc., Dayton, OH (US)

( * ) Notice: Subject to any disclaimer, the term of this patent is extended or adjusted under 35 U.S.C. 154(b) by 1590 days.

(21) Appl. No.: 10/962,153

(22) Filed: Oct. 7, 2004

(65) Prior Publication Data

US 2005/0076422 A1 Apr. 14, 2005

Related U.S. Application Data

(60) Provisional application No. 60/510,417, filed on Oct. 10, 2003.

(51) Int. Cl.

| | |
|---|---|
| ***A62B 17/00*** | (2006.01) |
| ***A62D 5/00*** | (2006.01) |
| ***A41D 1/00*** | (2006.01) |
| ***A41D 3/02*** | (2006.01) |

(52) U.S. Cl.
USPC ..... 2/458; 2/93

(58) Field of Classification Search
USPC ..... 2/458, 247, 81, 82, 87, 85, 93, 94, 96, 2/97, 101, 102, 227, 249; D2/839, 857, D2/836
See application file for complete search history.

(56) References Cited

U.S. PATENT DOCUMENTS

| | | | | |
|---|---|---|---|---|
| 1,426,024 | A | | 8/1922 | Thureson |
| 2,368,654 | A | | 2/1945 | Frank |
| 4,034,417 | A | | 7/1977 | Ellis |
| 4,369,526 | A | | 1/1983 | Clutts |
| D298,475 | S | * | 11/1988 | Viio ..... D29/101.3 |
| 4,887,317 | A | | 12/1989 | Phillips, Sr. et al. |
| 5,054,127 | A | | 10/1991 | Zevchak |
| 5,072,456 | A | | 12/1991 | Elin |
| 5,297,295 | A | * | 3/1994 | Barbeau et al. ..... 2/96 |
| 5,309,571 | A | | 5/1994 | Huang |
| 5,410,758 | A | | 5/1995 | Dupont et al. |
| 5,465,425 | A | | 11/1995 | Crispin |
| 5,542,124 | A | * | 8/1996 | Grilliot et al. ..... 2/81 |
| 5,708,978 | A | * | 1/1998 | Johnsrud ..... 2/102 |
| 5,718,000 | A | | 2/1998 | Ost et al. |
| 5,909,802 | A | * | 6/1999 | Puco et al. ..... 2/102 |

(Continued)

FOREIGN PATENT DOCUMENTS

| | | |
|---|---|---|
| DE | 19905476 | 8/1999 |
| EP | 1270045 | 1/2003 |
| EP | 1316262 | 6/2003 |
| FR | 2721179 | 12/1995 |

OTHER PUBLICATIONS

Office Action, Australian Patent Application No. 2004281692 (2 pages) (Apr. 30, 2009).

(Continued)

*Primary Examiner* — Amber Anderson

(74) *Attorney, Agent, or Firm* — Thompson Hine L.L.P.

(57) ABSTRACT

A protective garment including a body portion shaped to be worn on the torso and arms of a wearer. The body portion has a front surface, a rear surface, and lower edge. The protective garment further includes at least one pocket portion coupled to the front surface, wherein at least part of the pocket portion is located below the lower edge.

36 Claims, 6 Drawing Sheets

(56) References Cited

U.S. PATENT DOCUMENTS

| | | | | |
|---|---|---|---|---|
| D429,060 | S * | 8/2000 | Matthias | D2/830 |
| 6,131,198 | A | 10/2000 | Westrick | |
| 6,209,144 | B1 | 4/2001 | Carter | |
| 6,295,650 | B1 * | 10/2001 | Baacke | 2/94 |
| 6,345,393 | B1 | 2/2002 | Bayer | |
| 6,430,754 | B1 | 8/2002 | Taylor et al. | |
| 2002/0069453 | A1 | 6/2002 | Kelleher et al. | |

OTHER PUBLICATIONS

Office Action, Australian Patent Application No. 2004281692 (2 pages) (Nov. 30, 2009).
Office Action, Canadian Application No. 2,542,091 (5 pages) (Feb. 9, 2011).
Office Action, Canadian Application No. 2,542,091 (3 pages) (Apr. 8, 2010).

* cited by examiner

PROTECTIVE GARMENT WITH HANG-DOWN POCKETS

This application claims priority to provisional patent application Ser. No. 60/510,417 filed Oct. 10, 2003, the entire contents of which are incorporated by reference.

BACKGROUND

The present invention relates to garments and, more particularly, to protective garments having pockets.

Protective or hazardous duty garments are widely used in a variety of industries to protect the wearer from various hazardous conditions, such as heat, smoke, cold, sharp objects, chemicals, liquids, fumes and the like. The protective garment may include pockets to store equipment such as gloves, goggles, mechanical hardware, firefighting equipment, etc. These pocket may be desired to have a certain length or depth to ensure that the pockets can store relatively long or bulky items.

Although pockets of a certain height may be desirable, it may be undesirable to provide pockets which are located too high on the garment. In particular, firefighters and the like may use a self contained breathing apparatus ("SCBA") which may be carried by straps that extend across the chest and/or waist of a wearer. If the pockets are located too high on the garment, the straps of the SCBA system may extend across the pockets and thereby block access to the pockets. Furthermore, if pockets are located too high on the garment it may be difficult to access the pockets due to a user having to raise his or her arms too high in an awkward manner. Accordingly, there is a need for an improved protective garment with pockets.

SUMMARY

In one embodiment, the invention is a protective garment including a pocket that hangs below the lower edge of the garment. In particular, in one embodiment the invention is a protective garment including a body portion shaped to be worn on the torso and arms of a wearer. The body portion has a front surface, a rear surface and lower edge. The protective garment further includes at least one pocket portion coupled to the front surface, wherein at least part of the pocket portion is located below the lower edge.

In another embodiment, the present invention is a garment with pockets that are removably coupled to the body portion of the garment. In particular, in one embodiment the invention is a protective garment including a body portion shaped to be worn on and substantially cover the torso and arms of a wearer. The garment further includes at least one pocket portion configured to be removably attached to the body portion.

DETAILED DESCRIPTION

Figure 1:
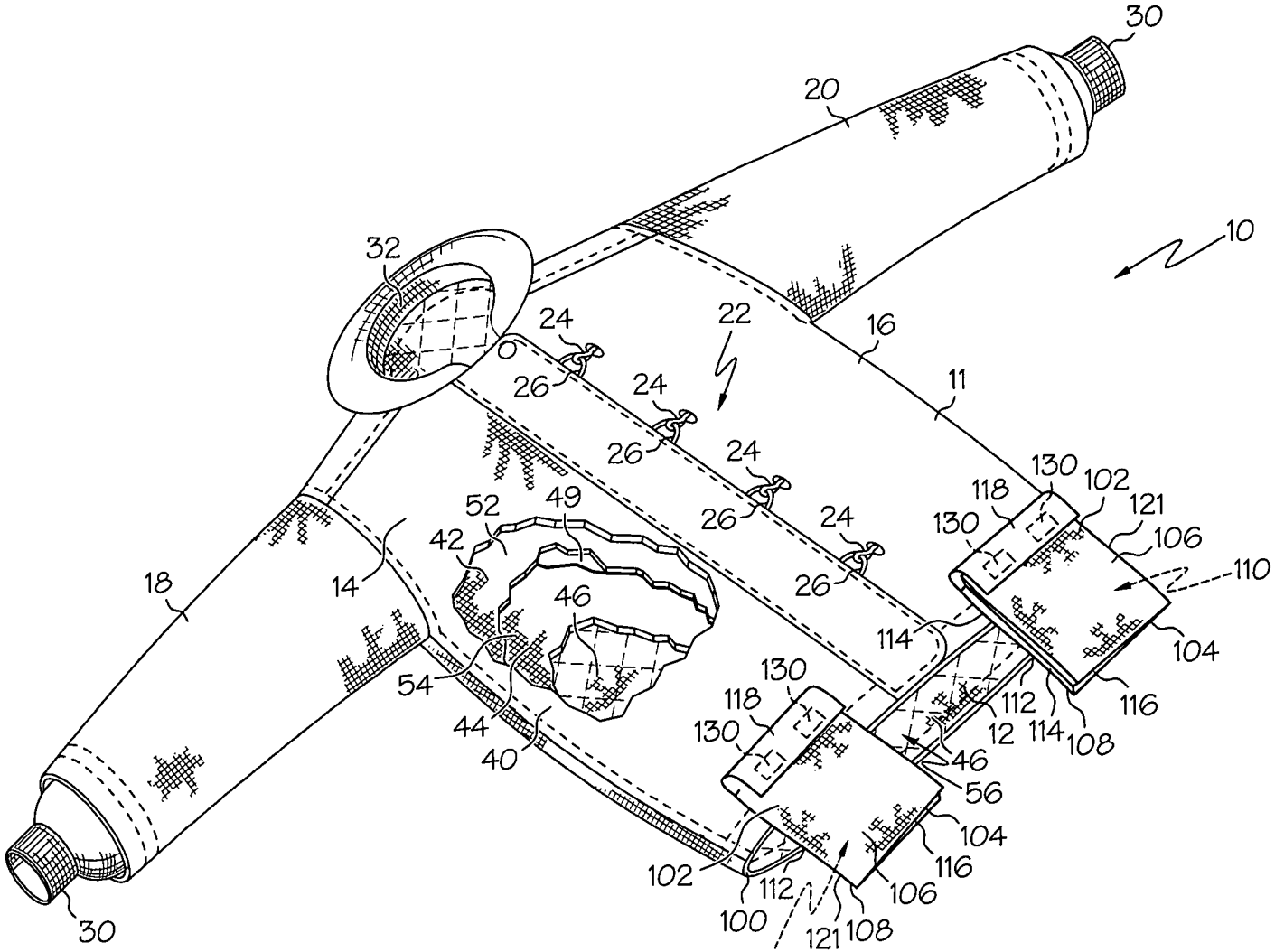
FIG. 1 is a front perspective view of one embodiment of the garment of the present invention, with certain portions of the garment cut way to reveal various layers of the garment.

FIG. 1 illustrates a protective or hazardous duty garment in the form of a firefighter turnout coat, generally designated 10. The coat 10 may include a body portion 11 having a back panel 12, and a left front panel 14 and a right front panel 16 coupled to the back panel 12. The body portion 11 may define a cavity or torso cavity 56 that is shaped to receive a wearer's torso or upper torso therein such that the body portion 11 is shaped to fit about the torso of a wearer. The coat 10 includes a pair of sleeves 18, 20 coupled to and extending generally outwardly from the back panel 12 and from the front panels 14, 16 and shaped to receive a wearer's arms therein.

The front panels 14, 16 may be fixedly and permanently (i.e. non-removably) attached to the back panel 12 and sleeves 18, 20 by stitching or the like. The panels 14, 16 may define an access opening 17 therebetween (FIG. 3) which allows a wearer to don and doff the garment. The panels 14, 16 may be releasably attachable together by a fastening component, generally designated 22 to selectively close the opening 17. In the embodiment shown in FIG. 1, the fastening component 22 includes hooks 24 located on front panel 16 which can cooperate with clasps 26 located on front panel 14 to selectively close the opening 17 and the coat 10. However, the fastening component 22 may be or include nearly any other fastener or fastening system, including but not limited to zippers (see FIG. 3), slide fastener components, snaps, buttons, hook and loop fastening systems (i.e. VELCRO®), straps, ties, and the like.

The coat 10 may include a pair of knit wristlets 30 which may be made of an aramid material and located at the distal end of each sleeve 18, 20. The coat 10 may also include a collar 32 of an aramid material attached to the back panel 12 and front panels 14, 16.

The coat 10 may include various layers through its thickness to provide various heat, moisture and abrasion resistant qualities to the coat 10 so that the coat 10 can be used as a protective, hazardous duty, or firefighter garment. For example, the coat 10 may include an outer shell 40, a moisture barrier 42 located inside of and adjacent to the outer shell 40, a thermal liner or barrier 44 located inside of and adjacent to the moisture barrier 42, and an inner liner or face cloth 46 located inside of and adjacent to the thermal liner 44.

The outer shell 40 may be of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Del.), and commercially available polybenzamidazole fibers include PBI fibers (a trademark of Celanese Corp. of Charlotte, N.C.). Thus, the outer shell 40 may be an aramid material, a blend of aramid materials, a polybenzamidazole material, a blend of aramid and polybenzamidazole materials, or other appropriate materials. The materials of the outer shell may have a weight of, for example, between about 6-10 $oz/yd^2$.

The moisture barrier 42 and thermal liner 44 may be generally coextensive with the outer shell 40, or spaced slightly inwardly from the outer edges of the outer shell 40 (i.e., spaced slightly inwardly from the outer ends of the sleeves 18, 20, the collar 32 and from the lower edge 100 of the garment 10) to provide moisture and thermal protection throughout the coat 10. The moisture barrier 42 may include a semipermeable membrane layer 49 and a substrate 52. The membrane layer 49 may be generally moisture vapor permeable but generally impermeable to liquid moisture.

The membrane layer 49 may be made of or include expanded polytetrafluoroethylene ("PTFE") such as GORE-TEX or CROSSTECH materials (both of which are trademarks of W.L. Gore & Associates, Inc. of Newark, Del.), polyurethane-based materials, neoprene-based materials, cross-linked polymers, polyamid, or other materials. The membrane layer 49 may have microscopic openings that permit moisture vapor (such as water vapor) to pass therethrough, but block liquids (such as water) from passing therethrough. The membrane layer 49 may be made of a microporous material that is either hydrophilic, hydrophobic, or somewhere in between. The membrane layer 49 may also be monolithic and may allow moisture vapor transmission therethrough by molecular diffusion. The membrane layer 49 may also be a combination of microporous and monolithic materials (known as a bicomponent moisture barrier), in which the microporous or monolithic materials are layered or intertwined.

The membrane layer 49 may be bonded or adhered to a substrate 52 of a flame and heat resistant material to provide structure and protection to the membrane layer 49. The substrate 52 may be or include aramid fibers similar to the aramid fibers of the outer shell 40, but may be thinner and lighter in weight. The substrate 52 may be woven, non-woven, spunlace or other materials. In the illustrated embodiment, the substrate 52 faces the outer shell 40. However, the orientation of the moisture barrier 42 may be reversed such that the membrane layer 49 faces the outer shell 40.

The thermal liner 44 may be made of any suitable material which provides sufficient thermal insulation. In one embodiment, the thermal liner 44 may include a relatively thick (i.e. between about 1/16"-3/16") batting, felt or needled non-woven material 54 which can include aramid fiber batting (such as NOMEX batting), aramid needlepunch material, an aramid non-woven material, an aramid blend needlepunch material, an aramid blend batting material, an aramid blend non-woven material, or foam (either open cell or closed cell) materials. The batting 54 preferably traps air and possesses sufficient loft to provide thermal resistance to the garment 10.

The batting 54 is typically quilted to the face cloth 46, and which can be a weave of a lightweight aramid material. Thus, either the batting 54 alone, or the batting 54 in combination with the face cloth 46, may be considered to be the thermal liner 44. In one embodiment, the thermal liner 44 may have a thermal protection performance ("TPP") of at least about 20, or of at least about 35. If desired, the thermal liner 44 may be treated with a water-resistant material.

Although the moisture barrier 42 is shown as being located between the outer shell 40 and the thermal liner 44, the positions of the moisture barrier 42 and thermal liner 44 may be reversed such that the thermal liner 44 is located between the outer shell 40 and the moisture barrier 42. The face cloth 46 may be the innermost layer of the garment 10, 12, and can provide a comfortable surface for the wearer and protect the batting 54 and/or moisture barrier 42 from abrasion and wear.

Each layer of the coat 10, and the coat 10 as a whole, may meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, an outer shell 40 of a firefighter garment must be able to resist igniting, burning, melting, dripping and/or separation at a temperature of 500° F. for at least five minutes. Furthermore, in order to meet the NFPA standards, all combined layers of the garment 10 must provide a thermal protection performance rating of at least 35.

Figure 2:
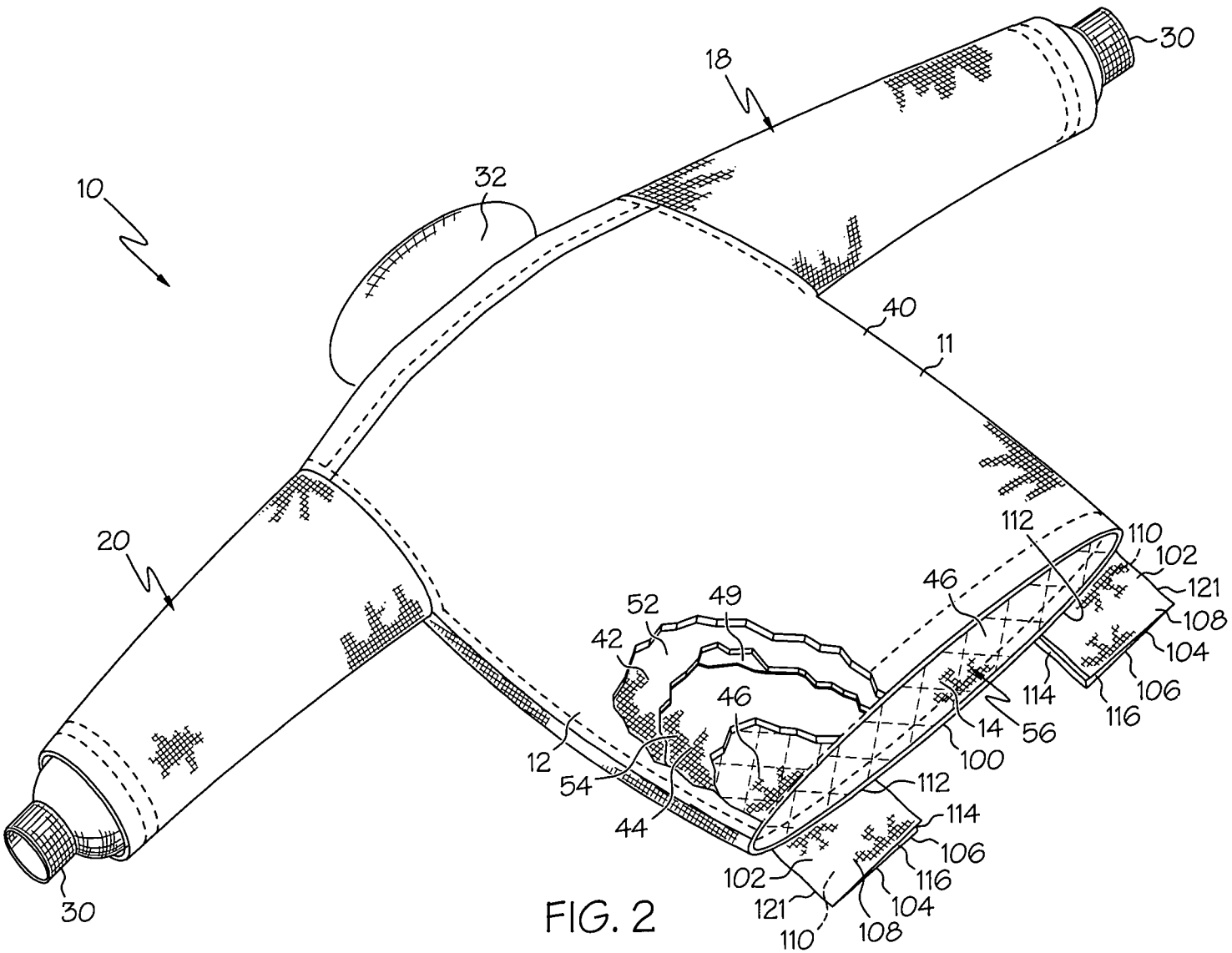
FIG. 2 is a rear view of the garment of FIG. 1 with certain portions cut away.

The body portion 11 may have a lower edge or hem 100. The lower edge or hem 100 may extend around the lower perimeter of the body portion 11 and may be a generally closed shape (i.e. an oval or the like) when the body portion 11 is in its closed position (i.e. when the front panels 14, 16 are coupled together as shown in FIGS. 1-2). The body portion 11 may include pocket or pocket portion 102 located on each of the front panels 14, 16. In the illustrated embodiment, the pockets 102 are located on the front of the body portion 11 and on either side of the central opening 17 or fastening component 22. Each pocket 102 may be located at least partially below the lower edge 100. For example, each pocket 102 may have a lower edge 104 that is located below the lower edge 100 of the body portion 11.

Each pocket 102 may include a front panel 106 fixedly coupled to the body portion 11. Each front panel 106 may be a generally flat, rectangular panel that is oriented generally parallel to the portion of the body portion 11 to which the front panel is coupled 106. Each pocket 102 may include a generally flat, rectangular back panel 108 (FIG. 2) that is fixedly coupled to the body portion 11 at its upper edge 112 such that a pocket cavity 110 is formed between the front panel 106 and the back panel 108 and between the front panel 106 and the body portion 11. The pocket cavity 110 may be located entirely outside of the torso cavity 56.

Figure 4:
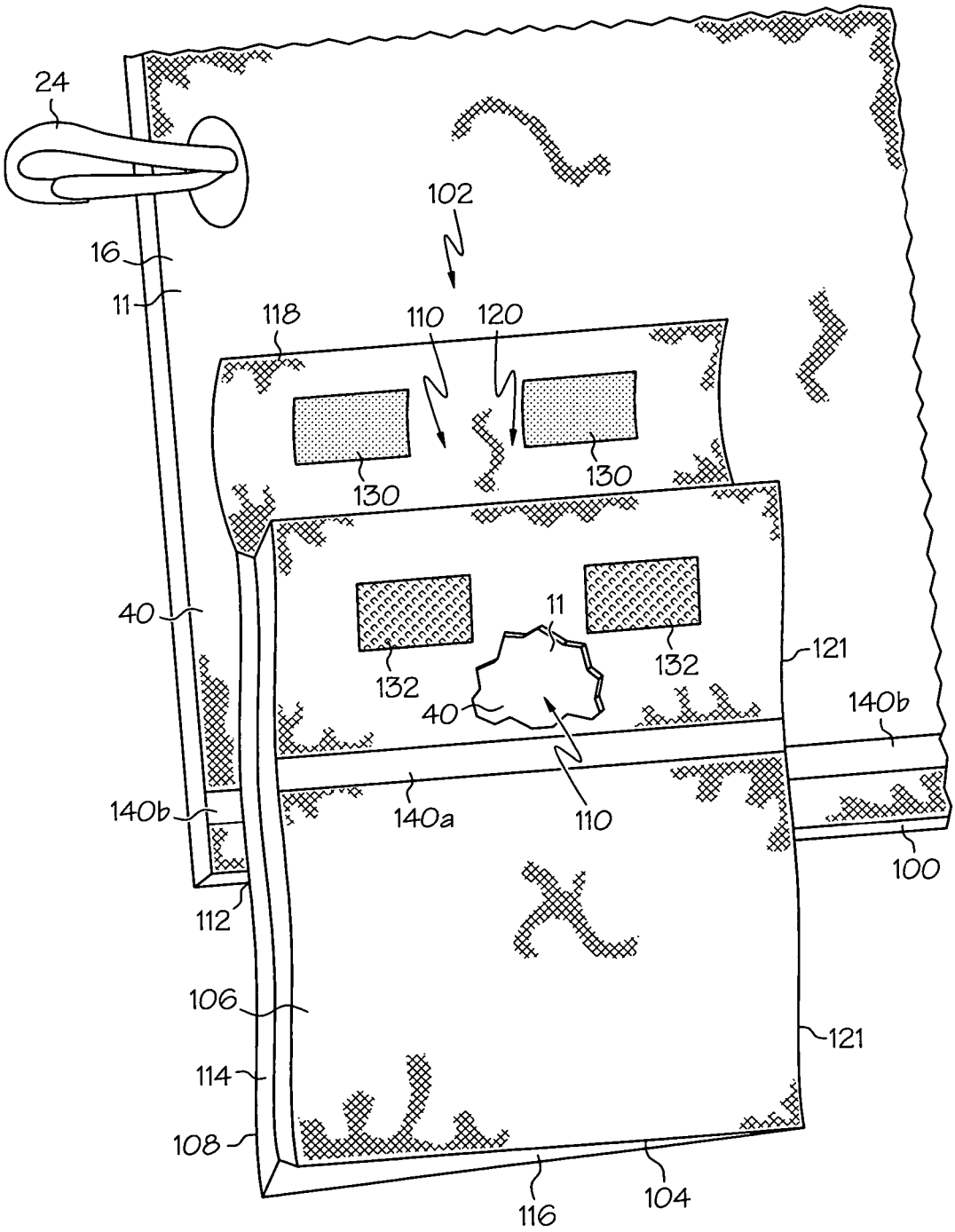
FIG. 4 is a detail front view of a pocket of the garment of FIG. 3.

In the embodiment shown in FIGS. 1 and 2, each back panel 108 may be located entirely at or below the lower edge 100. FIG. 4 includes a cutout formed in the upper central portion of the front panel 106 to illustrate the body portion 11 lying behind the front panel 106. In this case, the body 11/outer shell 40 defines part of the pockets 102 and their inner cavities 110. However, if desired the back panel 108 may have the same shape as the front panel 106 such that the cavity 110 is entirely located between the panels 106, 108 (shown in FIG. 5 and described below).

Each pocket 102 may include a side gusset 114 extending between the associated front panel 106 and the back panel 108/body portion 11, and oriented generally perpendicular to the first panel 106/back panel 108. In the illustrated embodiment each side gusset 114 is located on the inner edge of each pocket 102 (that is, the side of each pocket 102 facing the central opening 17 or fastener 22 of the garment 10). Each pocket 102 may also include a bottom gusset 116 located between the lower edges of the front panel 106 and the back panel 108. In the illustrated embodiment, the outer edges 121 of the pockets 102 do not include any gussets such that at the outer edge 121 the front panel 106 is directly attached to the body portion 11 and/or back panel 108, such as by stitching. However, if desired a gusset may be utilized at the outer edge 121. Furthermore, the pockets 102 need not necessarily include any side and/or bottom gussets, and the front panel 106 may instead be directly attached or coupled to the body portion 11 and/or the back panel 108 about the periphery of the front panel 106. The materials of the pockets 102 (i.e. the front panel 106, back panel 108, and gussets 114, 116) may be made of the same material as the outer shell 40, and the various materials may be stitched together to form the pockets 102.

Figure 3:
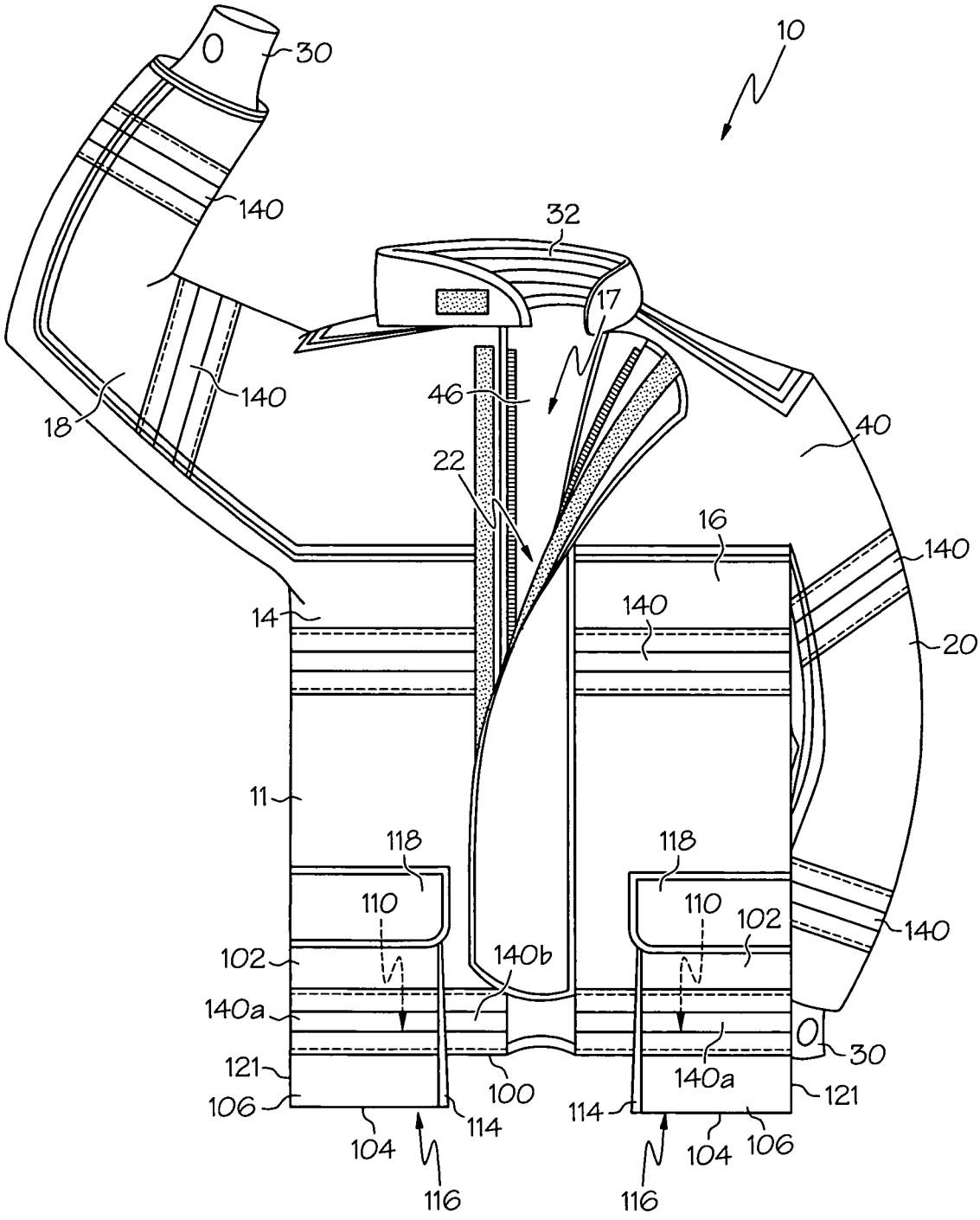
FIG. 3 is a front view of another embodiment of the garment of the present invention.

Each pocket 102 may include a closure flap 118 that can selectively cover the mouth 120 of each cavity 110 when in its closed position, as shown in FIGS. 1 and 3. FIG. 4 illustrates a closure flap 118 in its open position such that the closure flap 118 does not cover the associated mouth 120. As shown in FIG. 4, the closure flap 118 may be releasably attachable to the associated front panel 106, such as by patches 130 of hook-and-loop fastening material located on the underside of the closure flap 118, and corresponding patches 132 of hook-and-loop fastening material located on the front surface of the front panel 106. Of course, any of a wide variety of other mechanisms may be used to cover the mouth 120 and generally retain the closure flap 118/pocket 102 in its closed position including but not limited to slide fastener components, snaps, zippers, buttons, straps, ties, and the like.

As shown in FIG. 3, the garment 10 may include trim 140, such as reflective trim which extends around or adjacent to the lower edge 100 of the garment 10, or across the upper portions of the coat 10 and along the arms 18. The trim 140 may extend across the pockets 102 at an intermediate location thereof, or spaced away from a lower edge of the pocket 102, so that the trim 140*a* on the pockets 102 is aligned with the trim 140*b* on the lower portions of the body portion 11.

The hang-down nature of the pockets 102 enables the garment 10 to have relatively long pockets. Furthermore, because the pockets 102 (or the mouths 120) are located relatively low on the body portion 11, any straps located across the torso or waist of the wearer on the outside of the garment 10 are less likely to block access to the pockets 102. For example, it may be desired to have pockets that have a height or depth (i.e. the vertical dimension in FIG. 4) of at least about 10 inches. Furthermore, protective coats are often formed to a standard length (height) of about 35 inches or even 32 inches. A wearer may desire coats 10 which have relatively short length (i.e. in one case less than 35 inches or less than 32 inches) because shorter coats do not brush against a wearer's legs when the wearer is walking or running, and do not bunch up around the waist when the wearer bends over or squats down.

However, in coats which have a length of less than 35 inches or less than 32 inches with 10 inch pockets in a non-hang-down configuration, access to the pockets 102 may be blocked by straps from a SCBA apparatus which extends across the chest or waist or lower torso of the wearer. Furthermore, because the pockets in such a configuration may be located relatively high on the coat, it may be difficult to access the pockets. The hang-down nature of the pockets allows a wearer to wear a relatively short garment, while still having relatively long pockets that can be accessed even when the wearer utilizes SCBA gear. Of course, the present invention can be used in nearly any size and configuration of garment, and can allow for longer or various-sized pockets in any sized garment (including standard-length garment), while still providing relatively low pockets or pocket mouths for ease of access.

Figure 5:
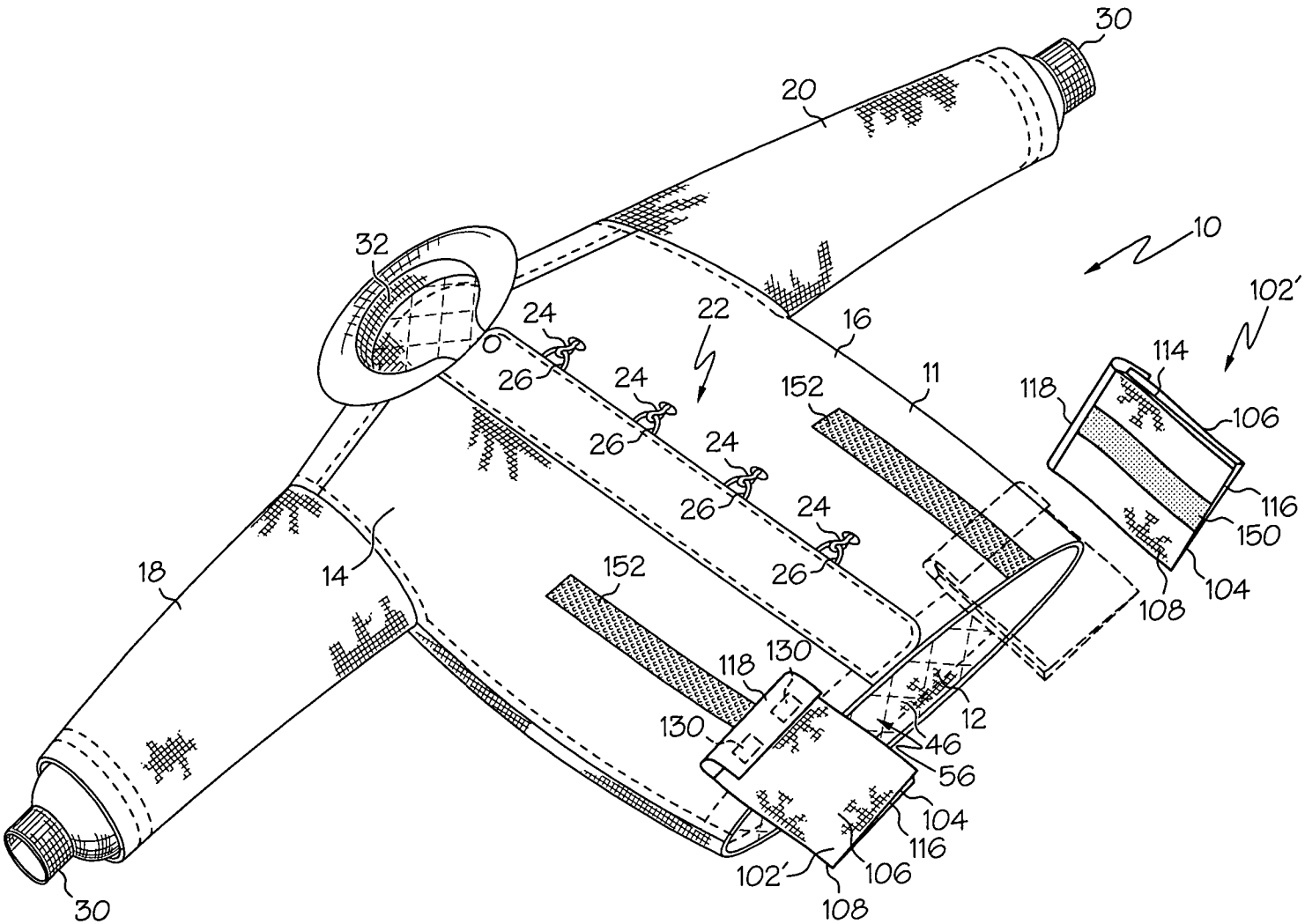
FIG. 5 is a front perspective view of another embodiment of the garment of the present invention.
Figure 6:
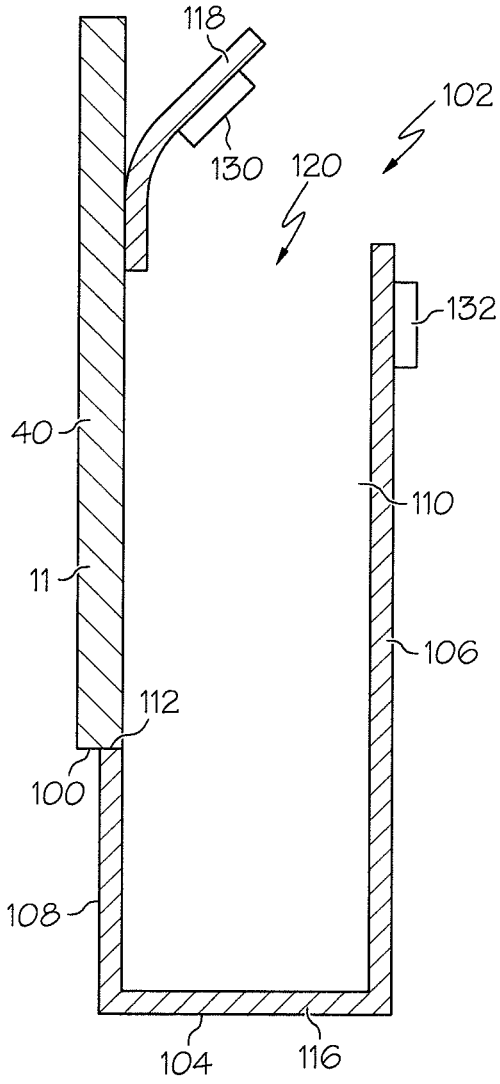
FIG. 6 is a side cross section of the pocket and garment portion of FIG. 4.

Instead of being fixedly coupled to the body portion 11 (such as by stitching) one or both of the pocket 102 may be removably coupled to the body portion 11. Furthermore, the pockets 102 may be removable attachable to the body portion 11 at a variety of heights or locations. For example, as shown in FIG. 5, each pocket 102' may include a pocket portion attachment structure 150 located therein. In the illustrated embodiment, the pocket portion attachment structure 150 is a strap of hook-and-loop fastening material 150 on its back side thereof. Each strap of hook-and-loop fastening material 150 may extend generally vertically (i.e. generally the entire height of the pocket 102').

The body portion 11 may include a body portion attachment structure 152 that can cooperate with the pocket portion attachment structure 150 to releasably couple the pockets 102' to the body portion 11. In the illustrated embodiment, the body portion attachment structure includes straps of hook-and-loop fastening material 152 located wherever the pockets 102' are desired to be able to be located. For example, the straps of hook-and-loop fastening material 152 may be located on the lower half of the body 11 and may extend down to the lower edge 100.

Each of the straps of hook-and-loop fastening material 152 on the body 11 may extend generally vertically, although the straps 150, 152 may have any of a wide variety of shapes and orientations. The pocket portions 102' thus may be able to be coupled to the garment 10 at a variety of locations in a vertical direction or in a direction extending generally parallel to the height of a wearer. In the embodiment shown in FIG. 5, the pockets 102' may include a full length backing panel (i.e. a back panel 108 that has the same length or height as the front panel 106 and/or the pocket 102') so that the pocket 102' forms a completely contained cavity 110 and can retain items therein even when the pocket 102' is detached from the body 11.

In this manner, the straps 152 of hook-and-loop fastening material on the pockets 102 may cooperate with the straps 150 of hook-and-loop fastening material on the body 11 to releasably attach or couple the pockets 102 to the body 11. The pockets 102 may then be attached to the body at the desired location and in the desired configuration. The straps 152 can be located at any location where it is desired to locate pockets including on the back panel 12, arms 18, 20, inner surface of the coat 10, etc. For example, the pockets 102 may be attached in a "hang-down" configuration (shown in FIG. 5) or in a non-"hang-down" configuration wherein the lower edge 104 of the pockets 102' are not located below the lower edge 100. Furthermore, instead of using straps of hook-and-loop fastening materials, various other attachment mechanisms, including but not limited to snaps, claps, hooks, interengaging geometries and the like may be utilized to releasably couple the pockets 102 to the body 11. In addition, the removable pockets can be used with a variety of garments, including pants or trousers, coveralls, jumpsuits or body suits, vests, or the like.

While the form of apparatus disclosed herein constitutes a preferred embodiment of the invention, it is to be understood that the present invention is not limited to this precise form of apparatus, and that variations and modifications may be made therein without departing from the scope of the invention.

What is claimed is:

1. A protective garment system comprising:

a body portion shaped to be worn on the torso and arms of a wearer, said body portion having a front surface, a rear surface, and lower edge, said body portion including an outer shell that is abrasion, flame and heat resistant, wherein said body portion includes a pair of sleeves, each sleeve being configured to receive the arm of a wearer therein and cover said arm received therein; and at least one pocket portion permanently coupled to said front surface, wherein at least part of said pocket portion is located on the body portion above said lower edge and a second part thereof is located below said lower edge;

wherein said part of said pocket portion located on said body portion is positioned more proximate said lower edge than where said sleeve is joined to said body portion such that access to said pocket portion is not blocked by straps from a self contained breathing apparatus when worn by a wearer wherein the pocket portion includes a single side gusset and includes a bottom gusset that gradually decreases in width from one side of the pocket to the other side of the pocket.

2. The garment system of claim 1 wherein said front surface is configured to cover the front of a wearer and said rear surface is configured to cover the rear surface of a wearer.

3. The garment system of claim 1 wherein said front surface includes a pair of front panels, said front panels being releasably attachable to each other such that when said front panels are detached from each other an access opening is located between said front panels to allow a wearer to don and doff said protective garment.

4. The garment system of claim 1 wherein said lower edge extends generally around the lower perimeter of the front and rear surfaces of said garment and is a generally closed shape when the garment is in a closed position.

5. The garment system of claim 1 wherein said pocket portion includes a front panel fixedly coupled to said body portion, said front panel being oriented generally parallel to a portion of the body portion to which the front panel is coupled, said pocket portion further including a back panel fixedly coupled to said front panel and said body portion such that a pocket cavity is formed between said front panel and said back panel and front panel and said body portion, said back panel being located generally entirely below said lower edge.

6. The garment system of claim 1 wherein said pocket portion defines a pocket cavity for receiving loose items therein, and wherein said body portion defines a torso cavity for receiving the torso of a wearer therein, and wherein said pocket cavity is located entirely outside of said torso cavity.

7. The garment system of claim 1 further comprising at least one supplemental pocket portion coupled to the body portion, at least part of said supplemental pocket portion being located below said lower edge.

8. The garment system of claim 1 wherein said garment meets National Fire Protection Association ("N.F.P.A.") 1971 standards for protective firefighting garments.

9. The garment system of claim 1 wherein said outer shell resists igniting, burning, melting, dripping or separation when exposed to a temperature of 500° F. for at least five minutes.

10. The garment system of claim 1 wherein said outer shell includes a material selected from a group of consisting of an aramid material, a blend of aramid materials, a polybenzamidazole material, and a blend of aramid and polybenzamidazole materials.

11. The garment system of claim 1 further comprising a moisture barrier located generally inside of said outer shell such that when said garment is worn said moisture barrier is located generally between said outer shell and a wearer of said garment, said moisture barrier being generally liquid impermeable to generally prevent moisture from passing from one side of said moisture barrier to the other and generally moisture vapor permeable to allow moisture vapor to pass from said one side to the other.

12. The garment system of claim 11 further comprising a thermal liner located generally inside said outer shell such that when said garment is worn said thermal liner is located generally between said outer shell and a wearer of said garment, wherein said thermal liner provides greater thermal insulation than said moisture barrier.

13. The garment system of claim 12 wherein said moisture barrier is generally located between said outer shell and said thermal liner.

14. The garment system of claim 13 further comprising a face cloth layer located inside of said thermal liner and located to be the innermost layer of said garment.

15. The garment system of claim 12 wherein said thermal liner includes a material selected from a group consisting of an aramid needlepunch material, an aramid batting material, an aramid non-woven material, an aramid-blend needlepunch material, an aramid-blend batting material and an aramid-blend non-woven material.

16. The garment system of claim 12 wherein said thermal liner has a thermal protection performance of at least about twenty.

17. The garment system of claim 1 wherein said pocket portion includes a pocket cavity for receiving loose items therein, said pocket cavity having a mouth, said pocket portion further including a closure flap movable between a closed position wherein said closure flap generally covers said mouth and an open position wherein said closure flap generally does not cover said mouth.

18. The garment system of claim 1 further comprising an inner garment worn by a wearer and positioned directly adjacent to the wearer's skin, wherein said protective garment covers said inner garment such that said inner garment is positioned between said protective garment and said wearer.

19. The garment system of claim 1 wherein said pocket portion is coupled to an outer surface of said front surface.

20. The garment system of claim 1 wherein said pocket portion includes a front panel coupled to said body portion and a back panel coupled to said front panel and to said body portion such that a pocket cavity is formed between said front panel and said back panel and between said front panel and said body portion, said back panel being located generally entirely below said lower edge.

21. The garment system of claim 1 wherein said at least one pocket portion includes a mouth, wherein at least part of said mouth is on the body portion interior from the lower edge thereof.

22. The garment system of claim 1 wherein said at least one pocket portion includes a mouth, wherein said mouth is on the body portion above the lower edge thereof.

23. The garment system of claim 1 wherein said second part of said pocket portion comprises about or more than 50% of the length of said pocket.

24. A protective garment system comprising:

a body portion shaped to be worn on the torso of a wearer, said body portion having a lower edge and being made of abrasion, flame and heat resistant material such that said body portion resists igniting, burning, melting, dripping or separation when exposed to a temperature of 500° F. for at least five minutes; and at least one pocket portion permanently coupled to a front surface of said body portion, wherein at least part of said pocket portion is located below said lower edge and at least another part of said pocket portion including a mouth of said pocket portion is located above said lower edge such that it positions said mouth relatively low on the body portion at a distance removed from said lower edge and said pocket portion is positioned entirely on said front surface such that access to said pocket portion is not blocked by straps from a self contained breathing apparatus when worn by a wearer wherein the pocket portion includes a single side gusset and includes a bottom gusset that gradually decreases in width from one side of the pocket to the other side of the pocket.

25. The garment system of claim 24 wherein said pocket portion defines a pocket cavity for receiving loose items therein, and wherein said body portion defines a torso cavity for receiving the torso of a wearer therein, and wherein said pocket cavity is located entirely outside of said torso cavity.

26. The garment system of claim 24 wherein said body portion includes a pair of sleeves, each sleeve being configured to receive the arm of a wearer therein and cover said arm received therein.

27. The garment system of claim 24 further comprising an inner garment worn by a wearer and positioned directly adjacent to the wearer's skin, wherein said protective garment covers said inner garment such that said inner garment is positioned between said protective garment and said wearer.

28. The garment system of claim 24 wherein said pocket portion is coupled to an outer surface of said body portion.

29. A protective garment system comprising:

a body portion shaped to be worn on and substantially cover the torso and arms of a wearer, said body portion having a lower edge, and defining a torso cavity for receiving the torso of a wearer therein, wherein said body portion is made of abrasion, flame and heat resistant material such that said body portion resists igniting, burning, melting, dripping or separation when exposed to a temperature of 500° F. for at least five minutes; and wherein said body portion further comprises a first front panel and a second front panel attached to a back panel, the first and second front panels defining an access opening therebetween; and at least one pocket portion permanently coupled to a front surface of the body portion on said first front panel or said second front panel, wherein said pocket portion defines a pocket cavity for receiving loose items therein, and wherein at least part of said pocket portion is located on the body portion above said lower edge and a second part thereof is located below said lower edge and wherein said pocket cavity is located entirely outside of said torso cavity, the pocket portion being positioned on the body portion adjacent to the access opening and relatively low on the body portion such that access to said pocket portion is not blocked by straps from a self contained breathing apparatus when worn by a wearer wherein the pocket portion includes a single side gusset and includes a bottom gusset that gradually decreases in width from one side of the pocket to the other side of the pocket.

30. The garment system of claim 29 wherein said body portion includes a pair of sleeves, each sleeve being configured to receive the arm of a wearer therein and cover said arm received therein.

31. The garment system of claim 29 further comprising an inner garment worn by a wearer and positioned directly adjacent to the wearer's skin, wherein said protective garment covers said inner garment such that said inner garment is positioned between said protective garment and said wearer.

32. The garment system of claim 29 wherein said pocket portion is coupled to an outer surface of said body portion.

33. The garment system of claim 29 wherein said pocket portion includes a front panel coupled to said body portion and a back panel coupled to said front panel and to said body portion such that a pocket cavity is formed between said front panel and said back panel and between said front panel and said body portion, said back panel being located generally entirely below said lower edge.

34. The garment system of claim 29 wherein said at least one pocket portion includes a mouth, wherein at least part of said mouth is on the body portion above the lower edge thereof.

35. The garment system of claim 29 wherein said at least one pocket portion includes a mouth, wherein said mouth is on the body portion above the lower edge thereof.

36. A protective garment system comprising:

a body portion shaped to be worn on the torso of a wearer, said body portion having a lower edge and being made of abrasion, flame and heat resistant material such that said body portion resists igniting, burning, melting, dripping or separation when exposed to a temperature of 500° F. for at least five minutes; and at least one pocket portion permanently coupled to said body portion, wherein at least part of said pocket portion is located below said lower edge and at least another part of said pocket portion is located above said lower edge;

wherein said pocket portion includes a front panel coupled to said body portion and a back panel coupled to said front panel and to said body portion such that a pocket cavity is formed between said front panel and said back panel and between said front panel and said body portion, said back panel being located generally entirely below said lower edge;

wherein the pocket cavity is constructed and arranged to store items in a position on the body portion that is accessible to the wearer when the protective garment is donned.

* * * * *